United States Patent [19]

Shaw

[11] 4,170,186

[45] Oct. 9, 1979

[54] ANCHORED OFFSHORE STRUCTURE WITH SWAY CONTROL APPARATUS

[75] Inventor: Clarence W. Shaw, Metairie, La.

[73] Assignee: J. Ray McDermott & Co., Inc., New Orleans, La.

[21] Appl. No.: 852,292

[22] Filed: Nov. 17, 1977

Related U.S. Application Data

[63] Continuation of Ser. No. 698,260, Jun. 21, 1976, abandoned.

[51] Int. Cl.[2] ..... B63B 21/52; B63B 51/02

[52] U.S. Cl. ..... 114/264; 405/202; 9/8 P; 114/293

[58] Field of Search ..... 61/86, 95, 93, 98; 175/5, 9; 114/256, 264, 266, 230, 293, 144 B; 9/8 P; 405/202, 195; 152/116–120; 182/19, 40, 41

[56] References Cited

U.S. PATENT DOCUMENTS

| | | | |
|---|---|---|---|
| 2,662,310 | 12/1953 | Villota | 115/7 |
| 3,031,997 | 5/1962 | Nesbitt | 9/8 P |
| 3,080,583 | 3/1963 | Fuller | 114/264 |
| 3,121,954 | 2/1964 | Foster | 114/144 B |
| 3,252,439 | 5/1966 | Shatto | 9/8 P |
| 3,360,810 | 1/1968 | Busking | 9/8 P |
| 3,422,783 | 1/1969 | Moulin | 114/144 B |
| 3,952,684 | 4/1976 | Ferguson | 114/230 |

*Primary Examiner*—Stephen G. Kunin
*Assistant Examiner*—D. W. Keen
*Attorney, Agent, or Firm*—Arnold, White & Durkee

[57] ABSTRACT

An offshore structure adapted to carry a drilling or production platform. The structure has a positive buoyancy and is tied-down to the ocean floor by tensioned cables such that the structure is maintained above the ocean floor and is tiltable. A plurality of anchored guy lines connect to the structure and are coupled to sway control apparatus that prevents excessive tilting of the structure by altering the length of the guy lines between the structure and the anchors. The sway control apparatus comprises first and second winches having a separate reel for each guy line, with each guy line being coupled to a reel through a rigging device mounted on the structure. The winches are operable in response to off-vertical movement of the structure as produced by excessive wind, waves and current.

10 Claims, 4 Drawing Figures

ANCHORED OFFSHORE STRUCTURE WITH SWAY CONTROL APPARATUS

This is a continuation of application, Ser. No. 698,260, filed June 21, 1976, now abandoned.

BACKGROUND OF THE INVENTION

The present invention relates to an offshore structure for disposition in a body of deep water; and more particularly, this invention relates to an offshore structure carrying a platform thereon and held by guy wires secured to anchors on the ocean floor.

Offshore structures in current use in connection with the drilling and production of hydrocarbon deposits in offshore locations have generally included a platform held above the surface of the water by support members which rest on the ocean floor. Such structures, referred to as fixed platforms, have been quite successfully utilized in operations conducted in shallow water. However, as offshore drilling operations move into areas having deeper waters, such as about 300 feet, the fixed platform design becomes less desirable, primarily because of the great expense to fabricate and install such a structure. As a general rule the cost of fabrication and installation of a fixed platform designed in accordance with proven shallow water methods and technology will increase exponentially with water depth.

Although an alternative to the fixed platform design is the floating platform concept, that approach is found to present additional, and perhaps even more serious disadvantages. Floating platforms have the disadvantage of being more susceptible to rough sea conditions and exhibit the undesirable feature of significant heave, pitch and roll motion.

Recently another type of structure for deep water offshore locations have been proposed which has a platform supported on buoyant members that are held in position at the well-site by anchor lines extending to fixed anchors on the ocean floor. Offshore platform structures of this type are referred to generally as "buoyant restrained platform." The basic principle is to provide a platform with buoyant chambers below the wave area to give a positive buoyancy and to tie the structure down to the ocean floor, allowing the buoyancy of the structure to hold the anchoring cables in tension to prevent heaving. Offshore structures of this type offer significant cost-savings for operation in deep-water environments.

Illustrative of the concept of buoyant restrained platform design is that structure disclosed in the article "Tension Leg Offers Steady Base At Sea" in the November 1973 issue of *OFFSHORE* magazine, beginning at page 100. The structure disclosed there comprises three buoyant vertical columns having horizontal bracing structure. A working deck is positioned on top of the vertical columns above the surface of the water. Several anchoring cables attach to each vertical column and are secured by dead weight anchors on the ocean floor. Anchor loads to hold the structure are significant, however, due to the resistance in the wave zone of the structure.

Additional designs based on the buoyant restrained platform concept are described in the *OFFSHORE ENGINEER* of May 1975, at page 55. Also, relevant teachings of the buoyant restrained platform concept are found in U.S. Pat. No. 3,256,537 to Clark and U.S. Pat. No. 2,777,669 to Willis.

A yet another approach which has been proposed is that of a structure comprising a slender column held in a vertical position by guy wires extending from near the top of the column to fixed anchors on the ocean floor. The column rests on the ocean floor and extends above the surface of the water with a platform supported thereon. Although the vertical column design has less resistance in its wave zone than the typical buoyant restrained platform design, some resistance is still present and forces are developed from periodic wave motion which act on the structure. A problem associated with guyed structures of this type is that tilting of the column off-vertical makes it very difficult to conduct drilling or production operations. However, increased tension in the guy lines to restrict tilting is not desirable either.

One approach to solving the problem of tilting is that described in U.S. Pat. No. 3,903,705, assigned to Exxon Production Research Company. There is disclosed in that patent a guyed tower platform using a clump weighted guy line system to control swaying and still relieve the structure of excessive moment forces produced by waves. The weights are designed to lift off the bottom during large storm waves, but remain in position during normal sea conditions. The guy line system provides adequate sway restriction, yet, relieves the guy lines of excessive stress and removes the need for heavier anchoring equipment.

Another concept proposed for an offshore structure to provide restricted movement with waves is that of the buoyant tower. The buoyant tower is an elongate tower structure that is held near the ocean floor by a universal joint that permits the tower to tilt. The force required to prevent the tower from tilting excessively is provided by the establishment of buoyancy for the tower near the surface of the water. One design based on the buoyant tower concept is the structure illustrated and described in *THE OIL AND GAS JOURNAL* of Oct. 28, 1974, beginning at page 60.

SUMMARY OF THE INVENTION

Briefly, in accordance with the present invention, there is provided a guyed offshore structure carrying a platform thereon from which drilling or production operations may be conducted. Specifically, the instant invention provides an offshore structure suitable for use in bodies of deep water, which structure permits restricted movement with waves, yet prevents excessive tilting of the structure.

The present invention makes use of the concepts of the buoyant restrained platform and the guyed structure, by providing an offshore structure comprising an elongate member for vertical disposition in a body of water with a buoyancy tank giving a positive buoyancy to the member. Anchoring lines connected between the lower end of the elongate member and anchors on the ocean floor tie-down the member, and in addition permit tilting of the structure. To restrict movement of the structure with waves, a plurality of guy lines connect between the elongate member and separate clump weight anchors that are disposed on the ocean floor. The clump weight anchors are adapted to raise off the ocean floor upon off-vertical movement of the elongate member. Finally, sway control apparatus operably connected to the guy lines alters line length between the connection point on the elongate member and the respective clump weight anchor. The sway control apparatus operates in response to off-vertical movement of the elongate member and prevents excessive tilting of the structure by reeling in or letting out guy line to keep the structure substantially vertical. The sway control apparatus also regulates tension in the guy lines.

In a more specific embodiment of the present invention, the anchoring lines connecting to the lower end of the elongate member define a universal pivot point. Also, the guy lines attach to the elongate member below the surface of the water at a point between the longitudinal mid-point of the elongate member and the top of the elongate member. The sway control apparatus comprises a separate reel for each guy line with means for driving the reels in response to an inclinometer device that detects off-vertical movement of a predetermined degree. The means for driving the reels may comprise an electric motor or similar type of prime mover device.

An offshore structure in accordance with the present invention has the advantage of offering significant cost-savings for operations in deep-water environments, with smaller anchor loads being required to hold the structure than usually found in buoyant restrained platform designs. Also, tilting of the elongate member, as usually found in most guyed structures, is much less because of the dynamic sway control apparatus provided. This invention, although especially suitable for use in drilling and production operations in deep water, is also useful in shallow water operations.

Other aspects of this invention not outlined in the above will be covered in the detailed description presented below.

BRIEF DESCRIPTION OF THE DRAWINGS

A more complete appreciation of the invention may be had by reference to the accompanying drawings illustrating a preferred embodiment of the invention to be described in detail, in which like reference numberals designate identical or corresponding parts throughout the several use and wherein.

DESCRIPTION OF THE PREFERRED EMBODIMENT

Figure 1:
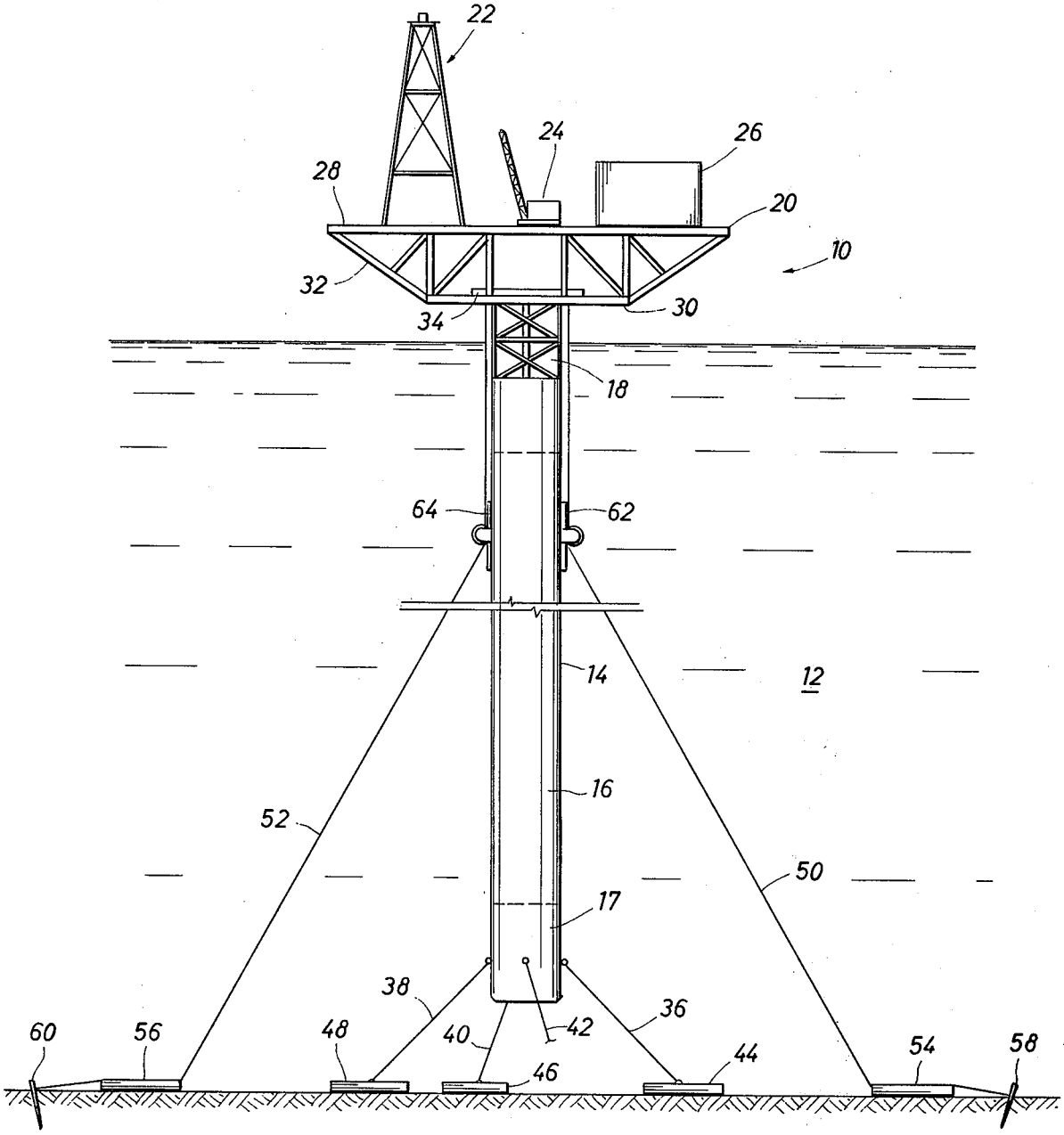
FIG. 1 is an elevation view of an offshore structure in accordance with the present invention having a drilling or production platform thereon.

Referring now to FIG. 1, there is shown an offshore structure 10 in accordance with the concepts of the present invention. The offshore structure 10 is disposed in a body of water 12 of any depth sufficient to accommodate the particular dimensions of the structure. However, the structure may be most advantageously used in a body of deep water, wherein the depth will be at least 300 feet, with a preferable depth range of 700–1500 feet.

An elongate tubular member 14, having an internal buoyancy tank 16 extending over a substantial portion of its length, is the primary structural component of the structure. The elongate tubular member 14 which houses the buoyancy tank 16 is designed to withstand the total hydrostatic and hydrodynamic pressure of the surrounding sea with only atmospheric pressure on the inside. The upper portion of tubular member 14 consists of skeleton structure 18 which reduces resistance in the wave zone of the structure. The skeleton structure comprises several upwardly extending struts along with several diagonal braces which form the X-bracing shown.

A two-level platform 20 is carried atop elongate member 14, and has mounted thereon a derrick 22 for carrying out drilling or production operations. In addition, various pieces of equipment such as, for example, a crane 24 are provided on the upper deck, as is a control building 26. The upper deck 28 is built atop the lower deck 30, which lower deck has a smaller floor area. Upper deck 28 is supported above lower deck 30 by means of a support and bracing structure generally denoted by the referenced numeral 32. Located on the lower deck 30 is the sway control apparatus 34 to be discussed in more detail in regard to FIG. 4. The elevations of the upper deck 28 and the lower deck 30 will be approximately 100 feet and 80 feet, respectively, above the surface of the water.

The buoyancy chamber 16 comprises a selectively ballastable and deballastable chamber. Selective ballasting of the buoyancy chamber 16 permits the exact amount of buoyancy effect necessary to offset the weight of the structure and the equipment mounted on the platform 20. Offshore structure 10 is floated in the water utilizing the positive buoyancy effects provided by the buoyancy tank 16, with anchoring lines 36, 38, 40 and 42 tying the structure to the ocean floor. The anchor lines connect between the lower end of elongate member 14 and individual dead-weight anchors 44, 46, 48 and 50 (not shown). The portion 17 of elongate member 14 proximate the connection point of the anchor lines is preferably ballasted with sea water or drilling mud to provide a negative buoyancy in that region.

In order to prevent an excessive tension from being placed on the anchoring lines, it is necessary to properly ballast the buoyancy tank 16. To properly set and maintain the correct load on the anchoring lines, the weight of the structure and the equipment which it supports must be determined during construction to provide an accurate account of total weight, as well as the resulting center of gravity for the structure. In addition, the buoyancy effect through water displacement by elongate member 14 must be considered. As well as the buoyant effect of the structure and the weight of the equipment load on the platform, in order to determine the amount of ballast necessary to be placed in the buoyancy tank 16, the water depth as well as changes in depth due to tidal variation should be considered.

By virtue of the tie-down arrangement provided by the anchoring cables connected to the lower end of elongate tubular member 14, the offshore structure 10 is in effect pivoted at its lower end, and therefore susceptible to tilting. In order to counteract swaying of the structure, guy lines, of which only guy lines 50 and 52 are shown in FIG. 1, extend radially outwardly (see FIG. 2) from the elongate tubular member 14. The guy lines attach to the elongate member 14 at a point between the longitudinal midpoint of elongate member 14 and the top of the elongate member, and extend down at approximately a 60-degree angle from vertical to a clump weight on the ocean floor. Each clump weight serves as an anchor and consists of a number of parallel segments of large-diameter chain connected to the guy line. The clump weights are designed to lift off the bottom during the existence of large waves. A more detailed discussion of the use of clump weights in connection with a guyed structure may be had by reference to U.S. Pat. No. 3,903,705 and to the July 14, 1975 issue of *THE OIL AND GAS JOURNAL*, at page 86 thereof. Beyond the clump weights 54 and 56, guy lines 50 and 52 extend to an anchor piles 58 and 60, respectively.

Figure 2:
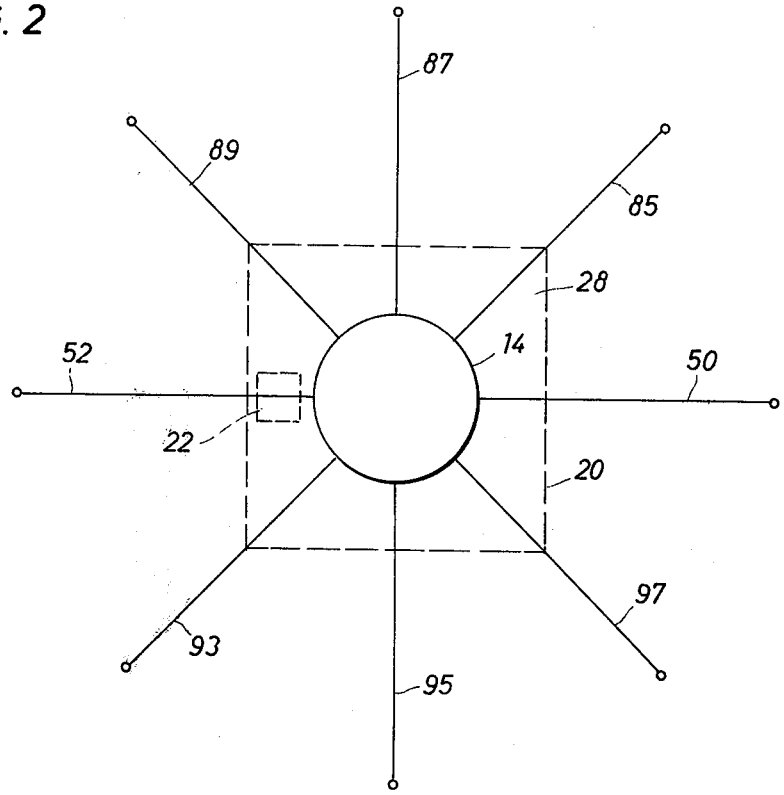
FIG. 2 is a planned view of the embodiment of the offshore structure of FIG. 1, which view illustrates the arrangement of the guy lines extending from the offshore structure.

Referring next to FIG. 2, the symetrical pattern of the guy lines 50, 85, 87, 89, 52, 93, 95 and 97 may be appreciated. Also shown in dotted outline is the platform 20 and derrick 22. Although a fewer or greater number of guylines than the eight illustrated may be used, the arrangement illustrated is preferred. In any event, in determining the number of guy lines to be used it must be appreciated that a sufficient number must be used to distribute the load imposed. An excessive number of guy lines may make the sway control apparatus 34 (see FIG. 4) too unwieldy, and thus impractical.

Figure 3:
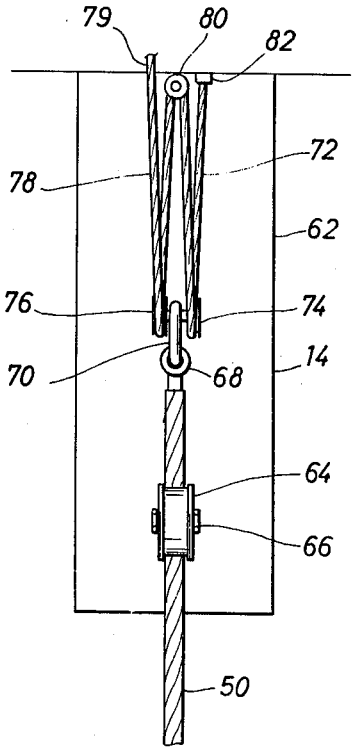
FIG. 3 illustrates a guy line tackle arrangement for the preferred embodiment illustrated.

The upper ends of the guy lines connect to guy line tackle devices 62 and 64 which are secured to the outer surface of the elongate member 14. The guy lines may often comprise rather large diameter cables which would not be adapted for winding on a winch drum. Hence, it is desirable to permit adjustment of the heavy guy lines using a smaller diameter cable windable on a winch. Turning to FIG. 3, one guy line tackle device is shown in detail in position on a section of elongate member 14. Specifically, guy line tackle device 62 comprises a fixed sheave 64 that is secured to the outside of elongate member 14, with its axis of rotation 66 being substantially perpendicular to the radially extending guy line 50 which passes over it. The end of guy line 50 terminates in an eyelet 68 which further connects to a traveling block 70. A pair of traveling block pulleys 74 and 76 receive a cable 78. Cable 78 encircles pulley 76 on traveling block 70 and passes over a fixed sheave 80 that is fixed relative to elongate member 14. The cable 78 then passes over the second pulley on traveling block 70 before its fixed end 72 terminates at dead end 82 which is also secured to the outside of elongate member 14. Thus, when the free end 79 of cable 78 is reeled in or let out via a winch or the like (not shown) the guy line 50 is either pulled in or let out. Movement in this fashion results in an increase or decrease in tension on guy line 50. Furthermore, use of the tackle mechanism illustrated maintains cable 78 under one-fourth the tension of guy line 50, and permits four times the footage movement of the cable 78 as compared to guy line 50 to accomplish more accurate adjustments of tension in the guy line 50. The tackle arrangement shown is illustrative only, and it will be understood that various other mechanisms might be used to adjust tension of the guy lines. Movement of guy line 50 in this manner also adjusts the length of line between clump weight 54 and the attachment point on elongate member 14 which is defined by sheave 66.

Figure 4:
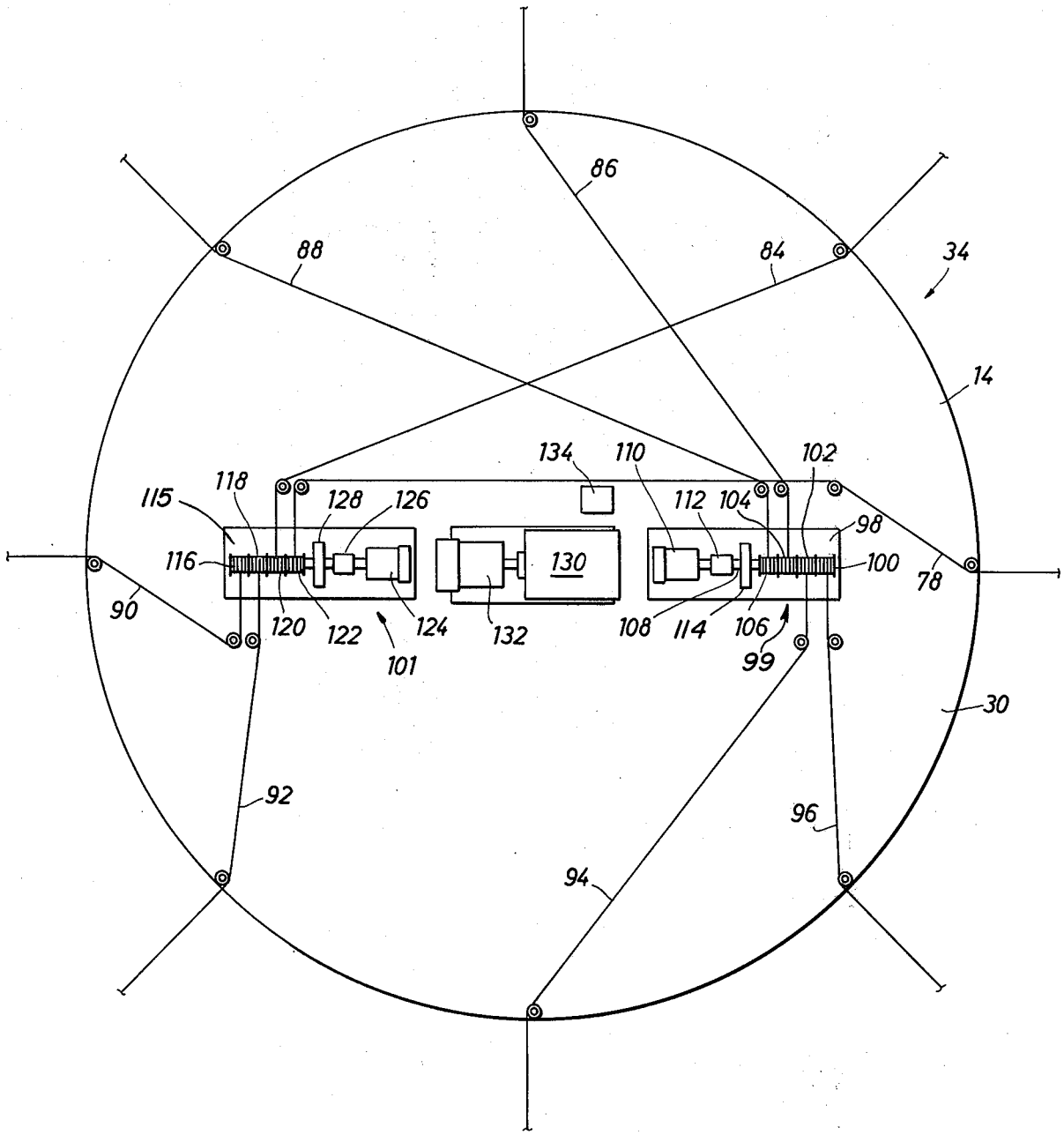
FIG. 4 is a plan view of the sway control apparatus disposed on the lower deck of the platform.

Referring next to FIG. 4, there is illustrated one configuration for sway control apparatus 34 which is disposed on lower deck 30, and which regulates guy line tension and alters the length of the guy lines between their point of attachment to elongate member 14 and their respective clump weight. Specifically, there is provided a separate winch line for each guy line, which winch lines are designated with referenced numerals 78, 84, 86, 88, 90, 92, 94 and 96, with winch line 78 corresponding to the cable 78 illustrated in the FIG. 3. Each winch line connects to a separate reel which either reels in or lets out its particular winch line to alter the length of and tension in the guy line to which that particular winch line is connected.

The reels are arranged in groups, in this case of four, and are skid mounted along with the prime mover device that drives them to form winch means 99 and 101. For example, winch means 99 comprises skid 98 having reel 100 for winch line 96, reel 102 for line 94, reel 104 for line 86, and reel 106 for line 88. The reels are all mounted on a single drive shaft 108 which is coupled to an electric motor 110 through a gear box 112 and a brake 114. Reels 102 and 100 are wound clockwise, while reels 104 and 106 are wound counterclockwise. This type of winding arrangement permits a single direction of rotation for the reels to be used to provide the appropriate reeling in and letting out of the various winch lines.

A similar arrangement exists for winch means 101 comprising skid 115 having reels 116, 118, 120 and 122 mounted thereon. These enumerated reels connect respectively to winch lines 90, 92, 84 and 78. An electric motor 124 simultaneously drives the reels through a gear box 126 with a brake 128 being provided.

In order to supply the required electric power for the electric motors 110 and 124, a diesel generator set is provided with a skid mounted diesel engine 130 driving an electric generator 132 to generate the required electric power for the sway control apparatus.

The sway control apparatus is responsive through motor controls to detection means 134 which senses off-vertical movement of the elongate member 14. Detection means 134 may be an inertial detector or an inclinometer, either of which may be utilized to generate a signal that activates the winch motors to drive the winches in the aforementioned manner to alter the length and tension of the guy lines. The sway control apparatus activates when the structure is displaced from vertical due to wind, waves, or current.

To illustrate the operation of the apparatus of this invention, if the tilting forces on the tower provide a resultant force from a direction between the extensions of lines 94 and 96 in FIG. 4, then only reels operating off winch means 99 likely need be activated to accomplish any adjustment. If, however, the resultant force is from a direction between the extensions of lines 78 and 96, both winch means 99 and 101 will require adjustment. Similarly, a resultant force from the direction between the extensions of cables 90 and 92 requires only adjustment of winch means 101, whereas a resultant force between the extensions of cables 92 and 94 would again require adjustments from both winch means.

The foregoing description of the invention has been directed to a particular preferred embodiment of the present invention for purposes of explanation and illustration. It will be apparent, however, to those skilled in this art that many modifications and changes in the apparatus may be made without departing from the scope and spirit of the invention. It is therefore intended that the following claims cover all equivalent modifications and variations as fall within the scope of the invention as defined by the claims.

What is claimed is:

1. An offshore structure for placement in a body of water comprising:

an elongate member for disposition in a body of water to extend above and below the surface of the water, said member being anchored to the ocean floor to permit tilting;

a plurality of guy lines radially arranged around said elongate member in connecting between said member and anchors of the ocean floor;

sway control apparatus operably connected to each of said guy lines for altering the length of said lines between said elongate member and said anchors in response to tilting of said elongate member;

said sway control apparatus includes first and second winch means;

said first winch means includes a first group of reels mounted on a common drive shaft which connects to a first group of guy lines and tilts said elongate structure along one direction by pulling in and letting out said first group of guy lines; and said second winch means includes a second group of reels mounted on a common drive shaft which connects to a second group of guy lines and tilts said elongate structure along another direction at a right angle to said one direction by pulling in and letting out said second group of guy lines.

2. The offshore structure of claim 1 further comprising:

a plurality of anchoring lines connected between the lower end of said elongate member and anchors on the ocean floor; and a buoyancy tank within said elongate member providing said elongate member with a positive buoyancy and placing said anchoring lines in tension with the lower end of said elongate member being disposed above the ocean floor.

3. The offshore structure of claim 2 wherein the connection of said anchoring lines to said elongate member defines a universal pivot point that permits said elongate member to tilt.

4. The offshore structure of claim 2 wherein said buoyancy tank comprises a selectively ballastable and deballastable chamber arranged within said elongate member.

5. The offshore structure of claim 4, further comprising guy line rigging devices for coupling the winch line on said reels to said guy lines.

6. The offshore structure of claim 4 wherein said means for driving said reels comprises an electric motor coupled to said reels through a gear box.

7. The offshore structure of claim 1 wherein said guy lines attach to said elongate member below the surface of the body of water at a point between the longitudinal midpoint of the member and the top of the member.

8. The offshore structure of claim 1 wherein said sway control apparatus comprises:

a separate reel for each guy line having a winch line wound thereon that couples to said guy line;

detection means for sensing off-vertical movement of said elongate member, and means for driving said reels to alter the length of the guy lines coupled to said winch lines in response to said detection means.

9. The offshore structure of claim 1 wherein said elongate structure comprises skeleton structure in the portion thereof that is in the wave zone.

10. An offshore structure for placement in a body of water comprising:

the elongate member for disposition in a body of water to extend above and below the surface of the water;

the plurality of anchoring lines connected between the lower end of said elongate member and anchors on the ocean floor with the connection of said anchoring lines to said elongate member defining a universal pivot point that permits said elongate member to tilt;

a buoyancy tank within said elongate member providing said member with a positive buoyancy and placing said anchoring lines in tension with the lower end of said elongate member being disposed above the ocean floor, said buoyancy tank being selectively ballastable and deballastable;

a plurality of guy lines radially arranged around said elongate member and connecting between said member and anchors on the ocean floor;

guy line tackles secured to the outer surface of said elongate member for connecting the upper ends of said guy lines to said member, each of said guy line tackles comprising a fixed sheave mounted to the outside of said elongate member with its axis of rotation being substantially perpendicular to a guy line passing thereover, a traveling block to which the upper end of a guy line attaches, said traveling block having first and second pulleys, and a cable terminating on one end at a dead end fixed relative to said elongate member and encircling the first and second pulleys on said traveling block;

detection means for sensing off-vertical movement of said elongate member; and sway control apparatus disposed on said elongate member to regulate guy line tension and alter the length of the guy lines between their point of attachment to said elongate member and said anchors in response to tilting of said elongate member, said sway control apparatus comprising first winch means having a separate reel for each of the first grouping of said guy lines and having the cable of each respective guy line tackle wound thereon, and second winch means having a separate reel for each of a second grouping of said guy lines and having the cable of each respective guy line tackle wound thereon, said first and second winch means being operable in response to said detection means to either reel in or let out particular ones of said guy lines.

* * * * *